US011348777B2

(12) United States Patent
Guna

(10) Patent No.: US 11,348,777 B2
(45) Date of Patent: May 31, 2022

(54) RF ION TRAP ION LOADING METHOD

(71) Applicant: DH Technologies Development Pte. Ltd., Singapore (SG)

(72) Inventor: Mircea Guna, North York (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 17/274,057

(22) PCT Filed: Sep. 4, 2019

(86) PCT No.: PCT/IB2019/057459
§ 371 (c)(1),
(2) Date: Mar. 5, 2021

(87) PCT Pub. No.: WO2020/049487
PCT Pub. Date: Mar. 12, 2020

(65) Prior Publication Data

US 2021/0351025 A1 Nov. 11, 2021

Related U.S. Application Data

(60) Provisional application No. 62/728,637, filed on Sep. 7, 2018.

(51) Int. Cl.
*H01J 49/00* (2006.01)
*H01J 49/42* (2006.01)

(52) U.S. Cl.
CPC ..... *H01J 49/004* (2013.01); *H01J 49/427* (2013.01); *H01J 49/4225* (2013.01); *H01J 49/4265* (2013.01)

(58) Field of Classification Search
CPC .. H01J 49/004; H01J 49/4225; H01J 49/4265; H01J 49/427
USPC ..... 250/281, 282, 283
See application file for complete search history.

(56) References Cited

U.S. PATENT DOCUMENTS

| | | | | |
|---|---|---|---|---|
| 5,729,014 | A | 3/1998 | Mordehai et al. | |
| 6,121,610 | A | 9/2000 | Yoshinari et al. | |
| 6,177,668 | B1 | 1/2001 | Hager | |
| 2011/0278917 | A1* | 11/2011 | Vandermey | H01F 19/04 307/3 |
| 2012/0292498 | A1* | 11/2012 | Jiang | H01J 49/4225 250/282 |
| 2019/0080896 | A1* | 3/2019 | Zhang | H01J 49/4255 |

OTHER PUBLICATIONS

International Search Report and Written Opinion for PCT/IB2019/057459 dated Dec. 12, 2019.

* cited by examiner

*Primary Examiner* — Nicole M Ippolito

(57) ABSTRACT

In one aspect, a method of processing ions in a mass spectrometer is disclosed, which comprises trapping a plurality of ions having different mass-to-charge (m/z) ratios in a collision cell, releasing said ions from the collision cell in a descending order in m/z ratio, and receiving the ions in a mass analyzer having a plurality of rods to at least one of which an RF voltage is applied, where the RF voltage is varied from a first value to a lower second value as the released ions are received by the mass analyzer.

19 Claims, 8 Drawing Sheets

RF ION TRAP ION LOADING METHOD

RELATED APPLICATION

This application claims priority to U.S. provisional application No. 62/728,637 filed on Sep. 7, 2018, entitled "RF Ion Trap Ion Loading Method," which is incorporated herein by reference in its entirety.

BACKGROUND

The present teachings are generally related to methods and systems for efficient transfer of ions having a range of m/z ratios into an ion trap, e.g., a linear ion trap (LIT), in a mass spectrometer.

Mass spectrometry (MS) is an analytical technique for measuring mass-to-charge ratios of molecules, with both qualitative and quantitative applications. MS can be useful for identifying unknown compounds, determining the structure of a particular compound by observing its fragmentation, and quantifying the amount of a particular compound in a sample. Mass spectrometers detect chemical entities as ions such that a conversion of the analytes to charged ions must occur during sample processing.

In tandem mass spectrometry (MS/MS), ions generated from an ion source can be mass selected in a first stage of mass spectrometry (precursor ions), and the precursor ions can be fragmented in a second stage to generate product ions. The product ions can then be detected and analyzed.

In some cases, precursor ions selected by an upstream mass filter can be introduced into an RF ion trap functioning as a collision cell in which they undergo fragmentation. The fragmented ions can then be received by a downstream LIT and released according to their m/z ratios, e.g., via mass selective axial ejection (MSAE), to be detected by a downstream detector.

Conventional linear ion traps can, however, exhibit poor trapping efficiency for large m/z ions at low applied RF voltage(s), due to low effective trapping potential. Increasing the applied RF voltage(s) can increase the trapping efficiency of large m/z ions but could adversely affect the trapping of low m/z ions because at higher applied RF voltage(s) the motion of the low m/z ions can become unstable. As a result, the mass range of linear ion traps is typically parsed using separate sample runs and pieced back together to be able to process ions having a wide range of m/z ratios. Such parsing of the mass range can, however, decrease the duty cycle and sensitivity.

Accordingly, there is a need for improved linear ion traps for use in mass spectrometry.

SUMMARY

In one aspect, a method of processing ions in a mass spectrometer is disclosed, which comprises trapping a plurality of ions having different mass-to-charge (m/z) ratios in a collision cell, releasing said ions from the collision cell in a descending order in m/z ratio, and receiving the ions in a mass analyzer having a plurality of rods to at least one of which an RF (radiofrequency) voltage is applied, where the RF voltage is varied from a first value to a lower second value as the released ions are received by the mass analyzer.

The change in the RF voltage from the first value to the second value is configured to ensure that efficient trapping of ions within the mass analyzer is achieved as the ions are released in a descending order in m/z ratio from the upstream collision cell to be received by the mass analyzer.

While in some embodiments the variation of the RF voltage applied to the mass analyzer, as the analyzer receives ions from the collision cell, can be linear, in other embodiments such variation can be nonlinear. In some embodiments, the variation of the RF voltage as a function of time can be characterized by decreasing portions separated by plateaus. In some embodiments, the RF voltage applied to the mass analyzer is decreased by at least about 80% as the ions having m/z ratios in a range of about 50 to about 1000 are received by the analyzer.

The ions received by the mass analyzer can then be released, e.g., via mass selective axial ejection (MSAE), to be detected by a downstream detector. For example, the ions contained in the mass analyzer can be released via MSAE in an ascending order in m/z ratio, i.e., from low m/z to high m/z ratio.

In some embodiments, the collision cell can comprise a plurality of rods arranged in a quadrupole configuration. One or more RF voltages can be applied to one or more rods of the collision cell to generate an electromagnetic field for radially confining ions within the collision cell. In some embodiments, one or more electrodes disposed in the proximity of the entrance and/or exit of the collision cell can be employed to apply an axial electric field to the collision cell for providing axial confinement of ions.

In some embodiments, the release of ions from the collision cell can be achieved via mass selective axial ejection (MSAE). By way of example, MSAE can be achieved via application of an AC excitation voltage to at least one rod of the collision cell to radially excite a subset of ions such that the interaction between the excited ions and the fringing fields at the distal end of the collision cell can cause the ejection of the ions from the collision cell. In some embodiments, the amplitude of the excitation voltage can be ramped from a first value to a second value, where the first value is lower than the second value. By way of example, the amplitude of the excitation voltage can be varied from about 0.2 volts to about 5 volts. In some embodiments, the excitation voltage is a dipolar voltage that is applied to a pair of the rods of the collision cell. In some embodiments, MSAE is performed by applying an excitation voltage to a lens disposed between the collision cell and the mass analyzer.

In some embodiments, ions are released from the collision cell by varying the amplitude of an AC voltage applied to the rods of a quadrupole rod set of the collision cell from a first value to a second value.

In some embodiments, a gas pressure pulse can be applied to the mass analyzer, in conjunction with the reduction of the RF voltage applied thereto, as ions are received by the mass analyzer. Such a pressure pulse can advantageously facilitate the cooling of the ions received by the mass analyzer, and enhance efficient trapping of ions having a large range of m/z ratios, e.g., in a range of about 30 to about 4000, in the mass analyzer.

In some embodiments, an ion source positioned upstream of the collision cell generates a plurality of ions and a filter, e.g., an RF/DC filter, disposed between the ion source and the collision cell is employed to select a subset of those ions for introduction into the collision cell.

In a related aspect, a mass spectrometer is disclosed, which comprises a source for generating a plurality of ions having different mass-to-charge (m/z) ratios, an ion trap for receiving and trapping at least a subset of said plurality of ions, where said subset comprises ions having different m/z ratios. A mass analyzer is positioned downstream of the ion trap. The mass analyzer can comprise a plurality of rods to at least one of which an RF voltage can be applied, and a controller for effecting release of the trapped ions from the ion trap in a descending order in m/z ratio and varying the RF voltage applied to at least one rod of the mass analyzer as the released ions are received by said mass analyzer.

In some embodiments, the ion trap can include four rods arranged in a quadrupole configuration. In some such embodiments, the ion trap can be configured as a collision cell.

In some of the above embodiments, the mass spectrometer can further include one RF voltage source for applying an RF voltage to at least one rod of the mass analyzer and a second RF voltage source for applying an RF voltage to at least one rod of the ion trap. Further, the mass spectrometer can include an excitation voltage source operating under the control of the controller for applying an excitation voltage across two rods of the ion trap for causing mass selective axial ejection (MSAE) of the ions from the ion trap.

In addition, the controller can control the RF voltage source supplying RF voltage to the mass analyzer to vary the amplitude of the RF voltage applied to at least one rod for the mass analyzer, e.g., to decrease the RF voltage, as the ions released from the ion trap are received by the mass analyzer.

Further understanding of various aspects of the present teachings can be obtained by reference to the following detailed description in conjunction with the associated drawings, which are described briefly below.

DETAILED DESCRIPTION

The present teachings relate generally to methods and systems for efficiently loading a mass analyzer ion trap. As discussed in more detail, in some embodiments, the mass analyzer ion trap can receive ions from an upstream collision cell. The amplitude of an RF confining voltage applied to the rods, e.g., quadrupole rod set, of the mass analyzer ion trap is reduced, e.g., in a linear or non-linear fashion, as ions are received by the mass analyzer. In this manner, the mass analyzer can be efficiently loaded with ions having a wide range of m/z ratios, e.g., m/z ratios in a range of about 30 to about 4000. As discussed in more detail below, in some embodiments, in addition to reducing the amplitude of the RF voltage applied to the rods of the mass analyzer, a gas pressure pulse can be applied to the mass analyzer to expedite cooling of the ions received thereby.

Figure 1:
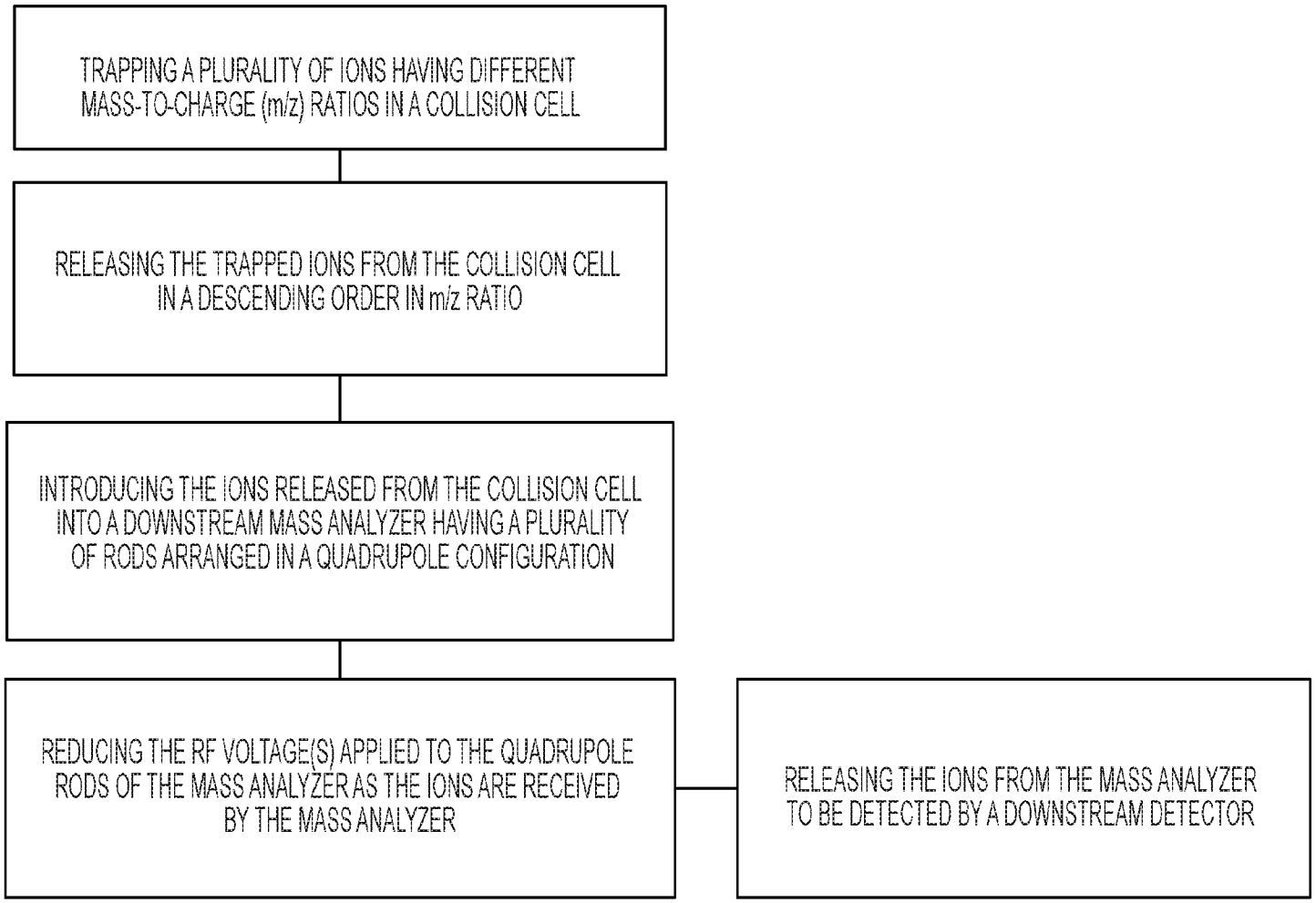
FIG. 1 is a flow chart depicting various steps in a method according to the present teachings for loading a mass analyzer with ions having a range of m/z ratios, FIG. 2 graphically depicts the release of ions from a collision cell in descending order in m/z and concurrent decrease of the amplitude of RF voltage(s) applied to the rods of a downstream mass analyzer positioned to receive the ions released from the collision cell, FIG. 3 graphically depicts the release of ions from a collision cell in a descending order in m/z ratio in a step-wise fashion and concurrent decrease in amplitude of RF voltage(s) applied to the rods of a downstream mass analyzer in a similar step-wise fashion and in concert with the release of the ions from the collision cell, FIG. 4A schematically depicts a mass spectrometer in accordance with an embodiment of the present teachings, FIG. 4B schematically depicts a gas source utilized in the mass spectrometer of FIG. 4A for applying pressure pulses to the mass analyzer of the mass spectrometer.

With reference to the flow chart of FIG. 1, in one embodiment of the present teachings for processing ions in a mass spectrometer, a plurality of ions having different mass-to-charge (m/z) ratios are trapped in a collision cell. The trapped ions are then released from the collision cell in a descending order in m/z ratio, and the released ions are received in a mass analyzer comprising a plurality of rods arranged in a quadrupole configuration to at least one of which an RF voltage can be applied to facilitate trapping the ions within the mass analyzer. The RF voltage applied to the mass analyzer is decreased as the ions are received by the mass analyzer. In some embodiments, the release of the ions from the collision cell can be achieved using mass selective axial ejection (MSAE).

Subsequently, the ions collected in the mass analyzer can be released, e.g., via MSAE, and the released ions can then be detected by a downstream detector.

Figure 2:
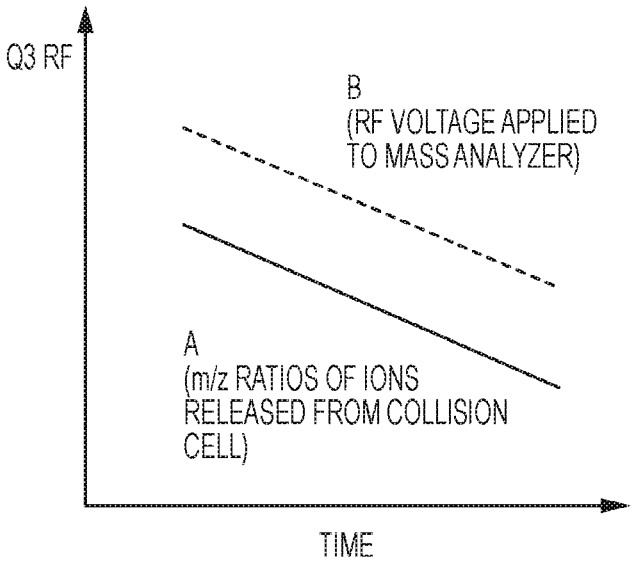

The RF voltage applied to the mass analyzer can be varied (decreased) as the ions released from the collision cell are received by the mass analyzer in a variety of different ways. By way of example, as shown in FIG. 2, the RF voltage applied to the mass analyzer can be varied (decreased) in a linear fashion as the ions are released from the collision cell and received by the mass analyzer. As shown in FIG. 2, in such an embodiment, the m/z ratio of ions exiting the collision cell decreases substantially linearly as a function of time. In concert with such release of ions from the collision cell, the amplitude of the RF confining voltage applied to the mass analyzer is decreased in substantially a linear fashion as well such that the RF voltage applied to the mass analyzer at a given time is suitable for confining ions received at that time. In other words, the RF voltage is varied so as to be suitable for confining ions received by the collision cell as the m/z ratios of those ions change. The collisional cooling of the higher m/z ions can facilitate the retention of those ions within the mass analyzer despite a reduction in the amplitude of the RF voltage as ions with lower m/z ratios are received by the mass analyzer.

Figure 3:
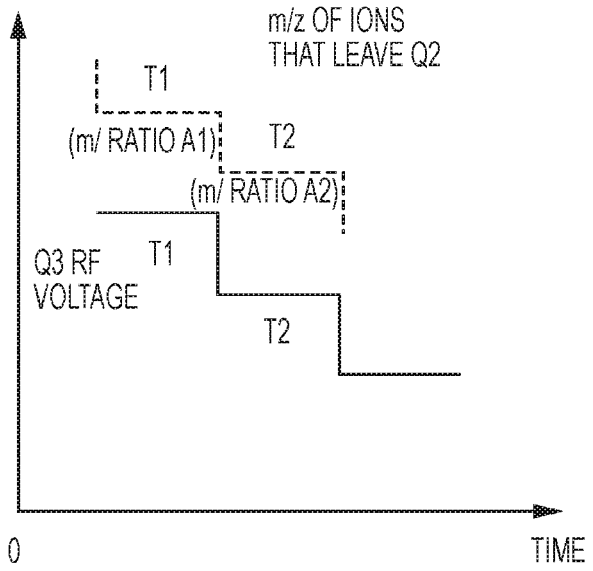

Alternatively, as shown in FIG. 3, the RF voltage applied to the mass analyzer can be varied in a stepped fashion. In the embodiment depicted in FIG. 3, ions are released from the collision cell in a stepped fashion. For example, during a time period T1, ions having an m/z ratio of A1 are released from the collision cell to be received by the downstream mass analyzer. During this time period, the RF voltage applied to the rods of the mass analyzer is configured to provide effective confinement of these ions. Subsequently, in the next time period T2, the ions released from the collision cell have an m/z ratio of A2. The RF voltage applied to the mass analyzer is decreased to provide effective radial confinement of these ions. This process can be repeated until all of the ions contained in the collision cell are released from the collision cell and received by the mass analyzer.

In many embodiments, the variation of the RF voltage applied to the mass analyzer as the analyzer receives the ions released from the collision cell can allow effectively trapping ions having m/z ratios spanning a large range, e.g., ions having m/z ratios in a range of about 50 to about 1000, in the mass analyzer.

The present teachings can be implemented in a variety of different mass spectrometers. By way of example and with reference to FIG. 4A, a mass spectrometer 1300 according to an embodiment includes an ion source 1302 for generating ions. The ion source can be separated from the downstream section of the spectrometer by a curtain chamber (not shown) in which an orifice plate (not shown) is disposed, which provides an orifice through which the ions generated by the ion source can enter the downstream section. In this embodiment, an RF ion guide (Q0) can be used to capture and focus the ions using a combination of gas dynamics and radio frequency fields. The ion guide Q0 delivers the ions via a lens IQ1 and Brubaker lens, e.g., approximately 2.35 long RF only quadrupole, to a downstream quadrupole mass analyzer Q1, which can be situated in a vacuum chamber that can be evacuated to a pressure that can be maintained lower than that of the chamber in which RF ion guide Q0 is disposed. By way of non-limiting example, the vacuum chamber containing Q1 can be maintained at a pressure less than about $1\times10^{-4}$ Torr (e.g., about $2\times10^{-5}$ Torr), though other pressures can be used for this or for other purposes.

As will be appreciated by a person of skill in the art, the quadrupole rod set Q1 can be operated as a conventional transmission RF/DC quadrupole mass filter that can be operated to select an ion type of interest and/or a range of ion types of interest. By way of example, the quadrupole rod set Q1 can be provided with RF/DC voltages suitable for operation in a mass-resolving mode. As should be appreciated, taking the physical and electrical properties of Q1 into account, parameters for an applied RF and DC voltage can be selected so that Q1 establishes a transmission window of chosen m/z ratios, such that these ions can traverse Q1 largely unperturbed. Ions having m/z ratios falling outside the window, however, do not attain stable trajectories within the quadrupole and can be prevented from traversing the quadrupole rod set Q1. It should be appreciated that this mode of operation is but one possible mode of operation for Q1. By way of example, in some embodiments, the quadrupole rod set Q1 is operated in RF only mode thus acting as an ion guide for ions received from $Q_0$.

Ions passing through the quadrupole rod set Q1 can pass through the stubby ST2, also a Brubaker lens, to enter a collision cell 1304 in which at least a portion of the ions undergo fragmentation to generate ion fragments. In this embodiment, the collision cell includes a quadrupole rod set, though other multi-pole rod sets can also be employed in other embodiments. An RF voltage source 1310*a* operating under the control of a controller 1312 applies RF voltages to the rods of the collision cell to radially confine ions within the collision cell. Further, in this embodiment, IQ2 and IQ3 lenses are disposed in proximity of the inlet and outlet ports of the collision cell. By applying DC voltages to the IQ2 and IQ3 lenses that are higher than the collision cell's rod offset, axial trapping of the ions can be achieved.

In some embodiments, the collision cell is maintained at a high pressure, e.g., at a pressure in a range of about 2 mTorr to about 15 mTorr, to ensure efficient cooling of ions contained therein.

Figure 4A:
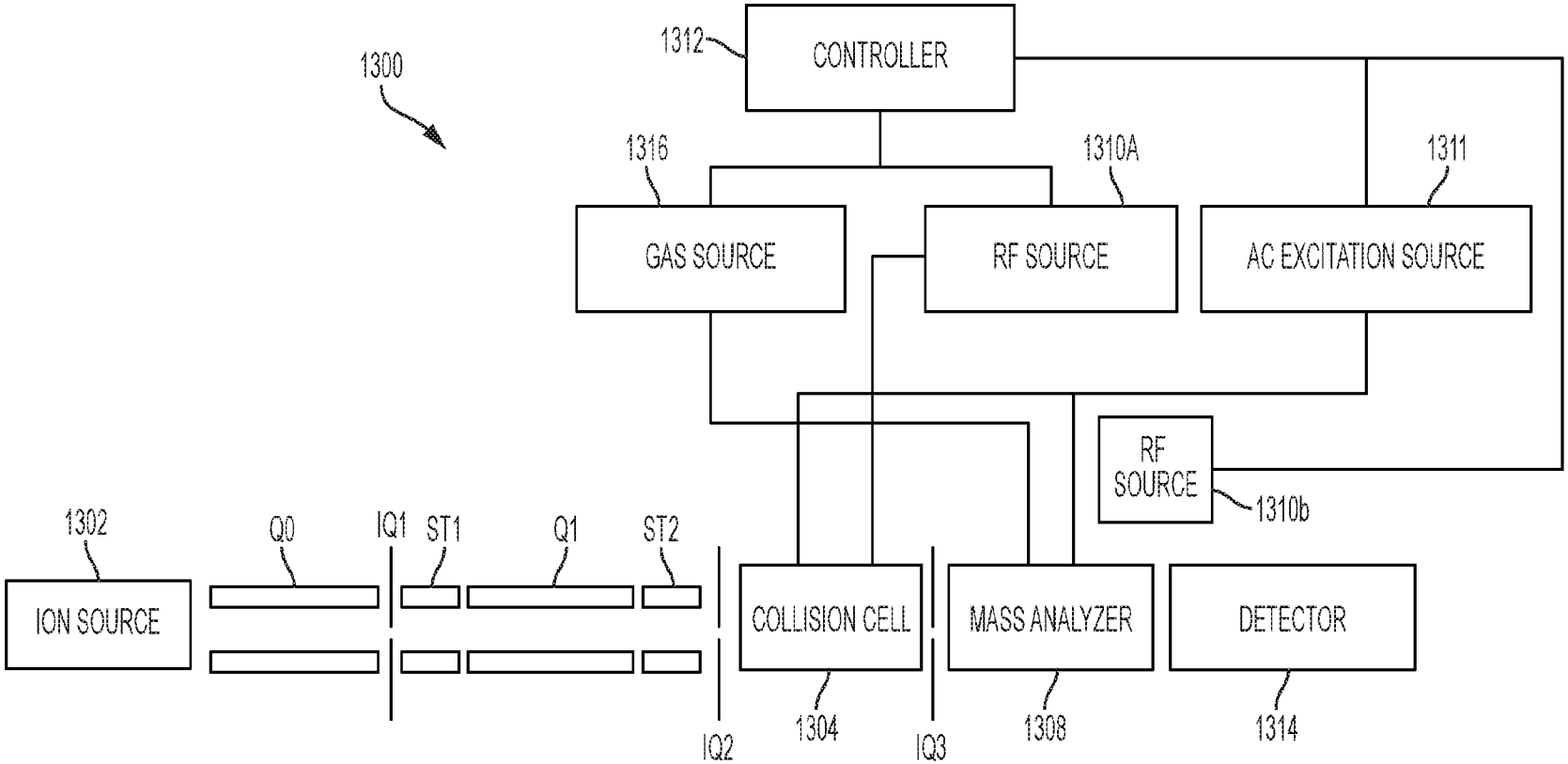

With continued reference to FIG. 4A, an analyzer ion trap 1308 is positioned downstream of the collision cell 1304. In this embodiment, the analyzer ion trap 1308 includes a quadrupole rod set to which RF voltages can be applied to provide radial confinement of ions therein. In some embodiments, one or more electrodes positioned in the proximity of the input and/or output ports of the analyzer ion trap (not shown) can be employed to generate axial fields within the analyzer ion trap, e.g., via application of DC voltages to the electrodes, for axial confinement of the ions.

Another RF voltage source 1310*b* operating under the control of the controller can apply RF voltages to the quadrupole rods of the analyzer ion trap. The controller can control the RF voltage source 1310*b* to reduce the amplitude of the RF voltage applied to the analyzer ion trap as ions are released from the collision cell and received by the analyzer ion trap. In some embodiments, the change in the amplitude of the RF voltage applied to the rods of the mass analyzer can be, for example, in a range of about 20% to about 90% The ions having higher m/z ratios received by the mass analyzer undergo collisional cooling while the amplitude of the applied RF voltage is decreased to accommodate the ions having lower m/z ratios. Such cooling of the higher m/z ions (e.g., ions having m/z ratios in a range of about 300 to about 1000) can facilitate the retention of those ions trapped in the mass analyzer despite the decrease in the amplitude of the applied RF voltage.

Figure 5A:
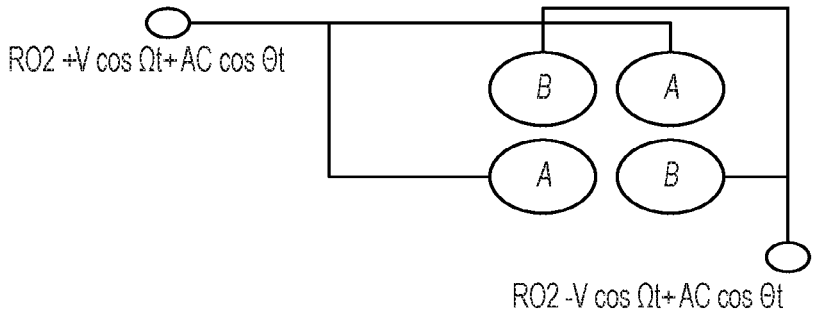
FIG. 5A depicts an example of application of excitation voltages to the rods of the collision cell of the mass spectrometer of FIG. 4A for releasing ions therefrom.

For example, FIG. 5A schematically depicts the quadrupole rods of the collision cell and the RF voltage applied thereto at a frequency of Ω for radially confining ions therein. As shown in this figure, the phase of the RF confining voltage applied to A rods is opposite to that applied to the B rods. In this embodiment, a DC voltage RO2 is also applied to the rods of the collision cell.

With reference to FIG. 5A as well as FIG. 4A, an AC excitation source 1311, which also operates under the control of the controller 1312, can apply an AC voltage at a frequency of Θ to all collision cell rods, to create an effective potential between the collision rods and the interquad lens IQ3.

In this embodiment, the fragment ions are axially trapped at the end of the collision cell by the DC voltage applied to the IQ3 lens. After a fill time that can vary from 1 ms to 200 ms, the DC voltage applied to the IQ2 is raised in order to prevent additional ions from entering the collision cell. In some embodiments, LINAC electrodes could be used to create an axial field across the collision cell in order to move the collisionally cooled ions toward the exit region of the collision cell.

Subsequently, the controller 1132 will increase the AC voltage of frequency Θ from zero voltage to a value large enough to create an effective potential between the collision cell rods and the IQ3 lens that would contain ions across the m/z window of interest even in the absence of a repulsive IQ3 voltage. After a short period, e.g., less than about 100 μs, the IQ3 DC voltage is changed to an attractive value relative to the RO2 rod offset. After an additional cooling period of less than about 1 ms, the AC amplitude is ramped down thus causing the release of ions contained within the collision cell in a descending m/z order. Such a mechanism for releasing ions from an ion trap, such as the collision cell 1304, is known in the art as "Zeno" pulsing.

In this embodiment, concurrent with the release of the ions from the collision cell, the controller can cause the RF source 1310*b* to decrease the amplitude of the RF voltage applied to the rods of the mass analyzer 1308. As discussed above, such a decrease can be achieved in a linear or a non-linear fashion. The total release time can vary from 1 to 20 ms depending on the m/z window. In some embodiments, the amplitude of the RF voltage applied to the rods of the mass analyzer can decrease by at least about 20%, e.g., in a range of about 20% to about 95%, from the start of the introduction of ions from the collision cell into the mass analyzer until the transfer of substantially all of the ions from the collision cell to the mass analyzer is accomplished. In some embodiments, the excitation voltage can be applied to the IQ3 lens.

Figure 5B:
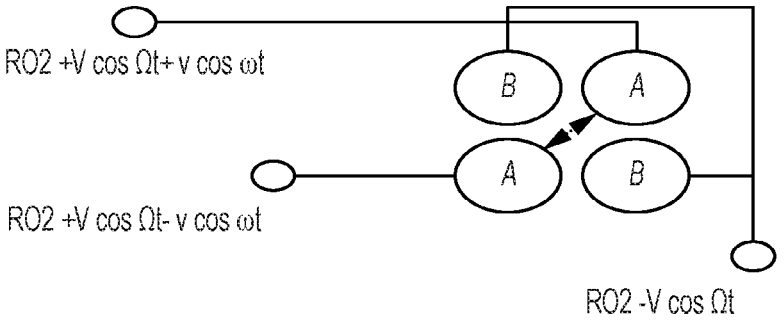
FIG. 5B depicts an example of application of excitation voltages to the rods of the collision cell and/or the mass analyzer of the mass spectrometer of FIG. 4A for releasing ions therefrom, FIG. 6 graphically depicts application of a dipolar voltage to two opposed rods of the collision cell to release ions therefrom in a descending order in m/z as well as the RF voltage applied to the rods of the downstream mass analyzer, depicting a decrease in the RF voltage as ions are received by the mass analyzer, and FIG. 7 graphically depicts application of a dipolar excitation voltage in a step-wise fashion to two opposed rods of the collision cell to release ions therefrom in a step-wise fashion in a descending order in m/z as well as the RF voltage applied to the rods of the downstream mass analyzer, where the RF voltage is decreased in a step-wise fashion in concert with the release of ions from the collision cell.

In another embodiment, the fragment ions contained in the collision cell are released by applying a dipolar excitation voltage differential across two rods of the quadrupole rod set of the collision cell. For example, FIG. 5B schematically depicts the quadrupole rods of the collision cell and the RF voltage applied thereto at a frequency of Ω for radially confining ions therein. As shown in this figure, the phase of the RF confining voltage applied to A rods is opposite to that applied to the B rods. In this embodiment, a DC voltage RO2 is also applied to the rods of the collision cell.

With reference to FIG. 5B as well as FIG. 4A, an AC excitation source 1311, which also operates under the control of the controller 1312, can apply an excitation voltage at a frequency of ω to the rods A, which are positioned radially opposite to one another. The frequency ω matches the frequency of the ions' secular motion in order to cause excitation of ions in the collision cell in order to cause their exit from the collision cell. More specifically, the controller can cause a ramping of the amplitude of the RF voltage so as to bring ions having different m/z ratios in resonance with the excitation voltage for causing their release from the collision cell. In this embodiment, the ramping of the amplitude of the excitation voltage is configured so as to cause the release of ions contained within the collision cell in a descending m/z order. Alternatively, the RF voltage can be maintained constant and the frequency of excitation can be increased such that the ions are excited and released from the trap in a decreasing m/z order.

In this embodiment, concurrent with the release of the ions from the collision cell, the controller can cause the RF source 1310*b* to decrease the amplitude of the RF voltage applied to the rods of the mass analyzer 1308. As discussed above, such a decrease can be achieved in a linear or a non-linear fashion. In some embodiments, the amplitude of the RF voltage applied to the rods of the mass analyzer can decrease by at least about 20%, e.g., in a range of about 20% to about 95%, from the start of the introduction of ions from the collision cell into the mass analyzer until the transfer of substantially all of the ions from the collision cell to the mass analyzer is accomplished. In some embodiments, the excitation voltage can be applied to the IQ3 lens. In some embodiments, the amplitude of the excitation voltage can be ramped with m/z.

Figure 6:
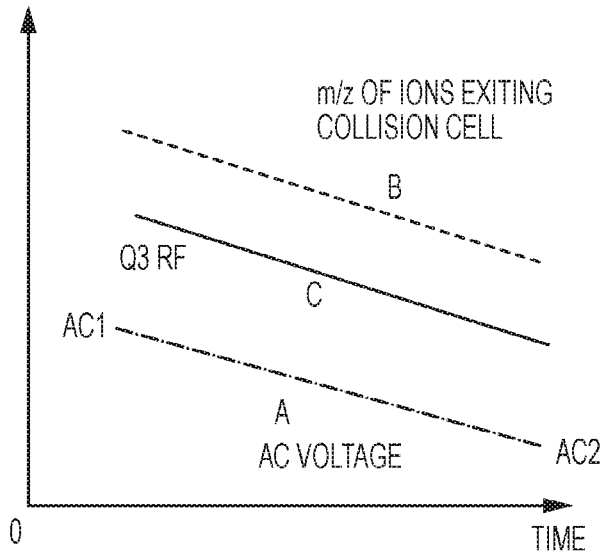

By way of further illustration, FIG. 6 schematically depicts that in some embodiments, the amplitude of an AC voltage applied to the rods of the collision cell depicted by graph A decreases monotonically in time from an initial value AC1 to final value AC2 to cause release of ions from the Q2 collision cell in a descending order in m/z as shown in graph B. Further, concurrent with the release of the ions from the collision cell, the amplitude of the RF confining voltage applied to the rods of the mass analyzer Q3 is decreased as shown schematically in graph C to allow for efficient trapping of ions released from the collision cell within the mass analyzer.

Figure 7:
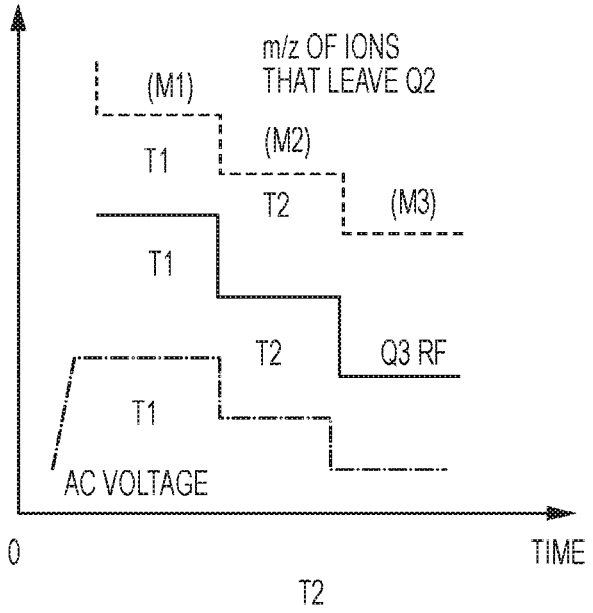

By way of further illustration, FIG. 7 schematically depicts that in some embodiments the amplitude of an AC voltage applied to the rods of the collision cell is varied in a step-wise fashion to cause release of ions having different m/z ratios in different time intervals. For example, during the time interval T1, the AC voltage applied to the collision cell causes the release of ions having an m/z ratio larger than M1 while during the time interval T2, the AC voltage applied to the collision cell causes the release of ions having an m/z ratio larger than M2, subsequently the AC voltage applied to the collision cell causes the release of ions having an m/z ratio larger than M3, where M1>M2>M3. As shown in FIG. 7, concurrent with the step-wise release of the ions from the collision cell, the amplitude of the RF confining voltage applied to the mass analyzer is decreased in a step-wise fashion so as to provide effective trapping of ions received from the collision cell.

Figure 4B:
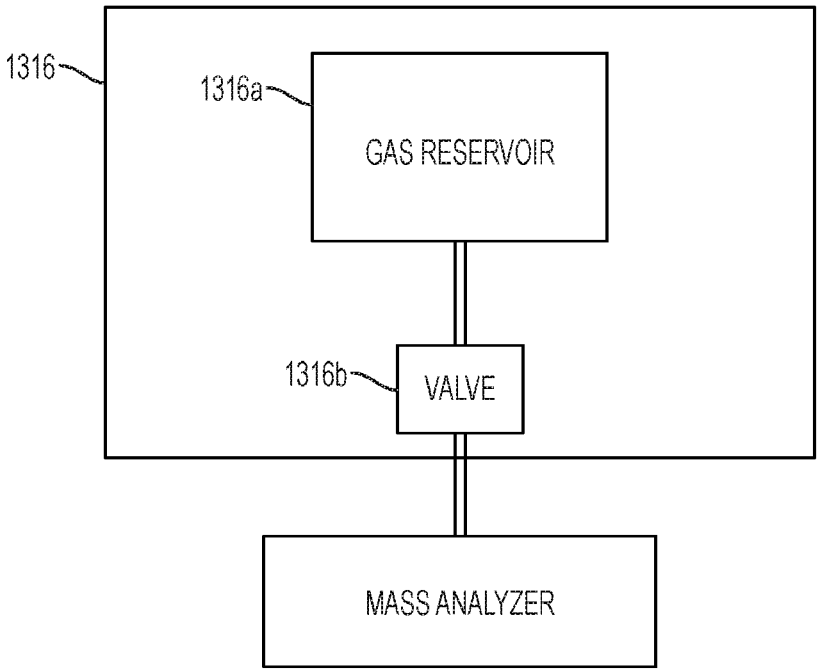

Optionally, in some embodiments, a gas pressure pulse can be applied to the mass analyzer as ions are released from the collision cell and are introduced into the mass analyzer. For example, as shown in FIG. 4A, in some such embodiments, a gas source 1316 operating under the control of the controller 1312 can be fluidly coupled to the mass analyzer. As shown schematically in FIG. 4B, the gas source 1316 includes a gas reservoir 1316*a* and a valve 1316*b* that couples the gas reservoir to the mass analyzer. The controller can actuate the valve 1316*b* to apply a pulse of gas to the mass analyzer to increase the internal pressure within the mass analyzer, thereby facilitating cooling of the ions. Such an increase in the internal pressure of the mass analyzer can facilitate the cooling of the ions, thereby helping with the retention of the higher m/z ions despite a reduction in the amplitude of the applied RF voltage for trapping the lower m/z ions. A variety of gases can be employed. Some suitable examples include, without limitation, nitrogen, and argon.

Subsequent to the collection of the ions in the mass analyzer, the ions can be released from the mass analyzer to be detected by a downstream ion detector 1314. By way of example, the release of the ions from the mass analyzer can be achieved via MSAE. The ions can be detected by the ion detector and the signals generated by the ion detector in response to the detection of the ions can be employed, e.g., via an analyzer (not shown), to form a mass spectrum.

The present teachings provide a number of advantages. For example, they allow for efficient trapping of both high m/z and low m/z ions. In other words, they allow for efficient trapping of ions having a wide range of m/z ratios, e.g., m/z ratios in a range of about 50 to about 2000. This can in turn enhance the duty cycle of mass analysis. For example, the implementation of the present teachings can result in at least a factor of 2 improvement in the duty cycle of mass analysis.

Those having ordinary skill in the art will appreciate that various changes can be made to the above embodiments without departing from the scope of the invention.

What is claimed is:

1. A method of processing ions in a mass spectrometer, comprising:

trapping a plurality of ions having different mass-to-charge (m/z) ratios in a collision cell, releasing said ions from the collision cell in a descending order in m/z ratio, receiving said ions in a mass analyzer having a plurality of rods to at least one of which an RF voltage is applied, wherein an amplitude of said RF voltage is varied from a first value to a lower second value as said released ions are received by the mass analyzer.

2. The method of claim 1, further comprising releasing said received ions from said mass analyzer via mass selective axial ejection (MSAE).

3. The method of claim 1, wherein said collision cell comprises a plurality of rods arranged in a quadrupole configuration.

4. The method of claim 3, wherein said step of releasing the ions from the collision cell comprises utilizing mass selective axial ejection (MSAE).

5. The method of claim 4, wherein said MSAE is performed by application of a dipolar voltage across two radially opposed rods of said plurality of rods of the collision cell.

6. The method of claim 5, wherein an amplitude of the excitation voltage is ramped from a first value to a second lower value to release ions from the collision cell in descending m/z ratio.

7. The method of claim 4, wherein said MSAE is performed by applying an excitation voltage to a lens disposed between said collision cell and said mass analyzer.

8. The method of claim 1, wherein said mass analyzer comprises a plurality of rods arranged in a quadrupole configuration.

9. The method of claim 8, wherein said RF voltage is applied to at least one of said plurality of rods.

10. The method of claim 1, wherein the amplitude of the RF voltage is varied linearly from said first value to said second value.

11. The method of claim 1, wherein the amplitude of the RF voltage is varied nonlinearly from said first value to said second value.

12. The method of claim 1, further comprising applying a gas pressure pulse to said mass analyzer ion trap as ions received by the mass analyzer ion trap from the collision cell.

13. The method of claim 1, further comprising performing the following steps prior to said step of trapping a plurality of ions:

generating ions, and mass selecting a subset of said generated ions for trapping.

14. The method of claim 1, further comprising mass selectively axially ejecting said ions from said mass analyzer from a low m/z ratio to a high m/z ratio.

15. A mass spectrometer, comprising a source for generating a plurality of ions having different mass-to-charge (m/z) ratios, an ion trap for receiving and trapping at least a subset of said plurality of ions, wherein said subset comprises ions having different m/z ratios, a mass analyzer positioned downstream of said ion trap, said mass analyzer comprising a plurality of rods to at least one of which an RF voltage can be applied, and a controller for effecting release of said trapped ions from the ion trap in a descending order in m/z ratio and varying an amplitude of the RF voltage applied to at least one rod of the mass analyzer as the released ions are received by said mass analyzer.

16. The mass spectrometer of claim 15, wherein said ion trap comprises four rods arranged in a quadrupole configuration.

17. The mass spectrometer of claim 15, further comprising at least a first RF voltage source for applying an RF voltage to said at least one rod of said mass analyzer and at least a second RF voltage source for applying an RF voltage to at least one rod of said ion trap for radially confining ions therein.

18. The mass spectrometer of claim 15, wherein said mass spectrometer further comprises an excitation voltage source operating under control of said controller for applying an excitation voltage across two rods of said collision cell for causing release of ions contained in the collision cell.

19. The mass spectrometer of claim 17, wherein said controller controls said first RF voltage source to cause varying the amplitude of RF voltage applied to said at least one rod of the mass analyzer as the released ions are received by the mass analyzer.

* * * * *